US011276943B2

(12) United States Patent
Sundararajan et al.

(10) Patent No.: US 11,276,943 B2
(45) Date of Patent: Mar. 15, 2022

(54) LOW-PROFILE VERTICALLY-POLARIZED OMNI ANTENNA

(71) Applicant: John Mezzalingua Associates, LLC, Liverpool, NY (US)

(72) Inventors: Niranjan Sundararajan, Liverpool, NY (US); Michael Enders, Jamesville, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 211 days.

(21) Appl. No.: 16/604,800

(22) PCT Filed: Apr. 17, 2018

(86) PCT No.: PCT/US2018/027921
§ 371 (c)(1),
(2) Date: Oct. 11, 2019

(87) PCT Pub. No.: WO2018/195047
PCT Pub. Date: Oct. 25, 2018

(65) Prior Publication Data

US 2021/0280988 A1 Sep. 9, 2021

Related U.S. Application Data

(60) Provisional application No. 62/488,298, filed on Apr. 21, 2017.

(51) Int. Cl.
*H01Q 21/20* (2006.01)
*H01Q 1/48* (2006.01)

(52) U.S. Cl.
CPC ..... *H01Q 21/205* (2013.01); *H01Q 1/48* (2013.01)

(58) Field of Classification Search
CPC ..... H01Q 21/00; H01Q 21/06; H01Q 21/205; H01Q 1/48
See application file for complete search history.

(56) References Cited

U.S. PATENT DOCUMENTS 3,771,162 A 11/1973 Diens
6,819,291 B1 11/2004 Lackey et al.
(Continued)

FOREIGN PATENT DOCUMENTS

WO 2012/110098 A1 8/2012
WO WO-2012110098 A1 * 8/2012 ..... H01Q 1/241

OTHER PUBLICATIONS

International Search Report and Written Opinion; International Application No. PCT/US18/27921; dated Jun. 11, 2018 and dated Jul. 3, 2018, 16 pages.
(Continued)

*Primary Examiner* — Hoang V Nguyen
(74) *Attorney, Agent, or Firm* — Barclay Damon LLP

(57) ABSTRACT

An omni-directional antenna including a plurality of stacked omni-directional antenna core assemblies. Each antenna core assembly comprises a conductive ground plane defining an axis normal to the ground plane and a plurality of conductive plates projecting orthogonally from the conductive ground plane and angularly spaced about the axis. Each of the plates defines an edge extending radially outboard from the central axis and diverging away from the conductive ground plane as the radial distance increases from the central axis. The edge defines a first region defining an acute angle relative to the conductive ground plane and a second region, radially outboard of the first region defining an arcuate shape.

16 Claims, 8 Drawing Sheets

(56) References Cited

U.S. PATENT DOCUMENTS

| | | | | |
|---|---|---|---|---|
| 9,000,996 | B2 * | 4/2015 | Holland | H01Q 13/085 343/795 |
| 2001/0043157 | A1 | 11/2001 | Luk et al. | |
| 2005/0248499 | A1 | 11/2005 | Park et al. | |
| 2011/0057852 | A1 | 3/2011 | Holland et al. | |

OTHER PUBLICATIONS

International Preliminary Report of Patentability; International Application No. PCT/US18/027921; dated Sep. 23, 2019 and dated Oct. 11, 2019, 21 pages.

* cited by examiner

6/8

LOW-PROFILE VERTICALLY-POLARIZED OMNI ANTENNA

TECHNICAL FIELD

This disclosure is directed to an antenna for use in telecommunications systems and, more particularly, to a new and useful stacked omni-directional antenna which improves isolation and minimizes the geometric envelope.

BACKGROUND

With the current push to make cities more connected and "smarter", cellular network densification has taken a leading role. However, urban deployment of cellular networks offers considerable challenges. First, it is often not practical or possible to deploy conventional macro cell antennas that are typically mounted on towers, given the large size of the antennas and the expensive and visually undesired mechanical infrastructure required for mounting them. Second, conventional macro cellular antennas have distinctive gain patterns that concentrate RF energy in rather tight beams, which can lead to challenges in meeting urban RF regulatory guidelines. Accordingly, a compact cellular antenna is needed to effect a well-defined gain pattern that does not concentrate RF energy, and can be deployed in urban environments with minimal infrastructure.

SUMMARY

A low profile omni antenna is provided including a plurality of stacked omni-directional antenna core assemblies. Each antenna core assembly comprises a conductive ground plane defining an axis normal to the ground plane and a plurality of conductive plates projecting orthogonally from the conductive ground plane and angularly spaced about the axis. Each of the plates defines an edge extending radially outboard from the central axis and diverging away from the conductive ground plane as the radial distance increases from the central axis. The edge defines a first region defining an acute angle relative to the conductive ground plane and a second region, radially outboard of the first region defining an arcuate shape.

Additional features and advantages of the present disclosure are described in, and will be apparent from, the following Brief Description of the Drawings and Detailed Description.

DETAILED DESCRIPTION

The telecommunications antenna of the present disclosure is described in the context of a Distributed Antenna System (DAS) useful for providing telecommunications coverage in confined areas, buildings and irregularly-shaped spaces. Recently, it has become desirable to incorporate small vertically polarized antennas in mailboxes, newsstands and/or other portable, semi-permanent structures that are located in high density pedestrian areas. The typical geometric envelope for such applications may include a tubular space, i.e., in the shape of a column, having a diameter less than about three inches (3.0"), and a height dimension which between about nine inches (9") to about twenty-four inches (24").

Figure 1:
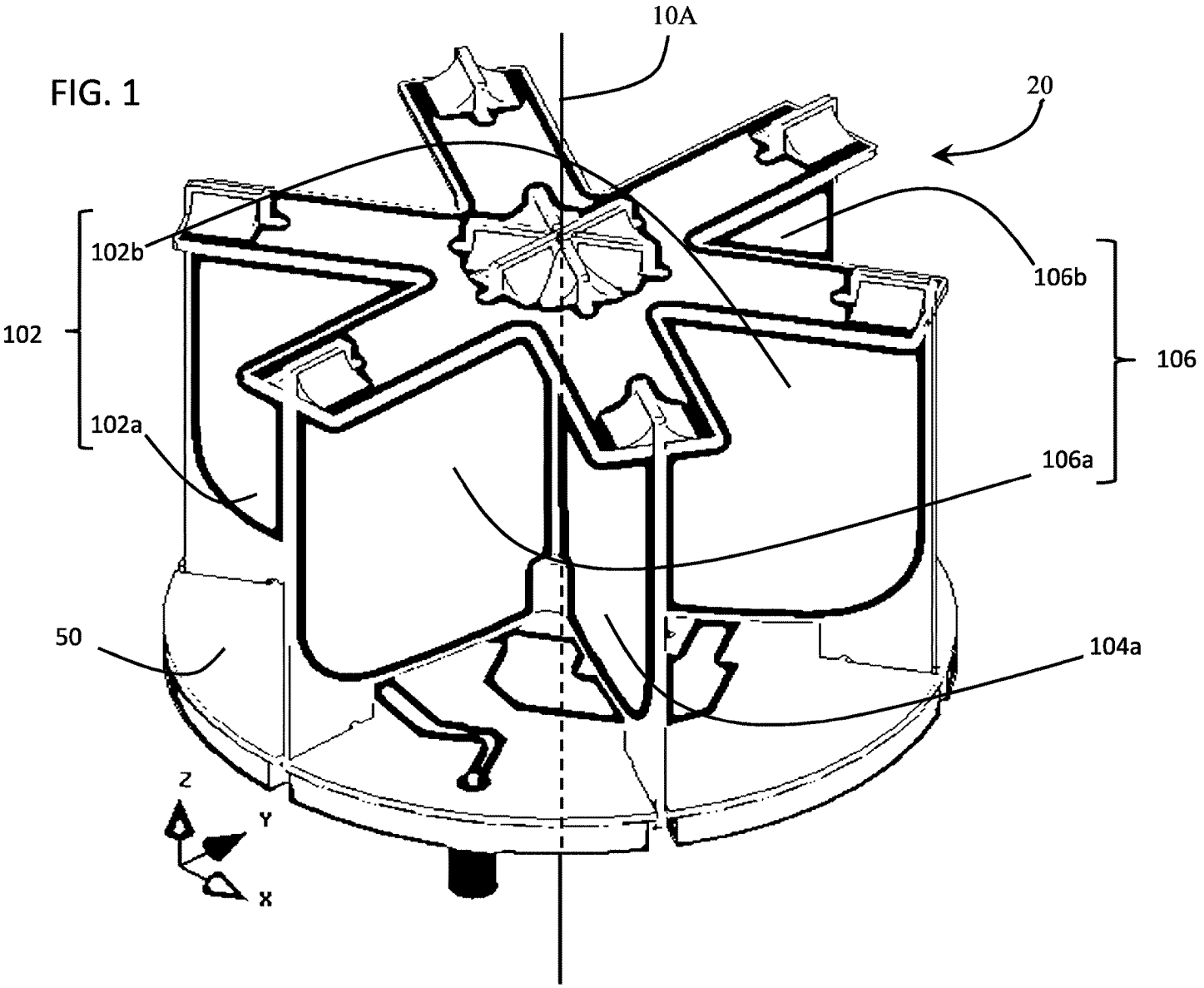
FIG. 1 is a perspective view of an omni-directional antenna core assembly for use in a low profile omni antenna including a conductive ground plane, and a plurality of conductive plates projecting orthogonally from the conductive ground plane and equiangularly spaced about a central axis which is orthogonal to the conductive ground plane.
Figure 3:
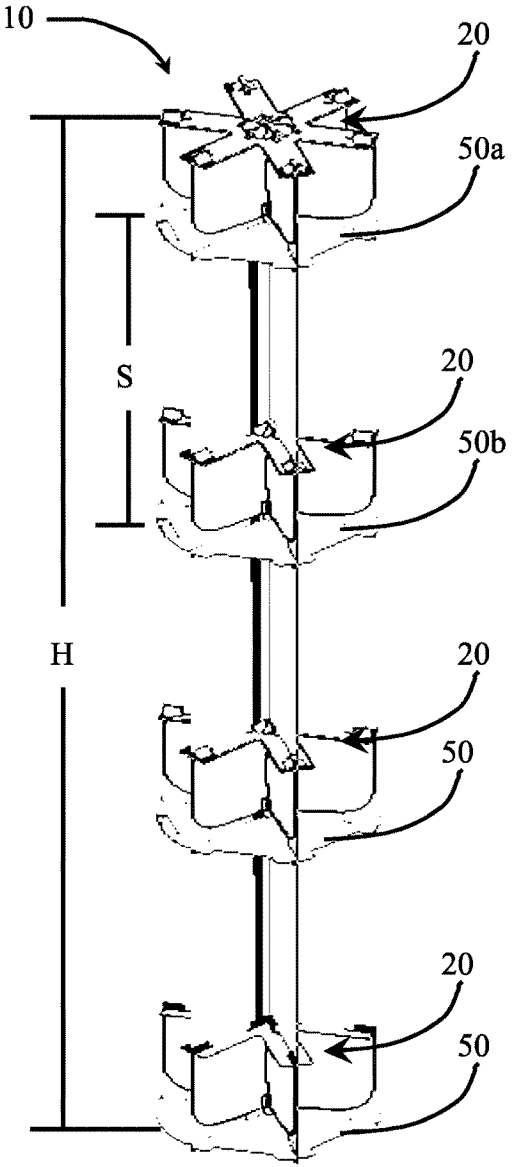
FIG. 3 depicts a plurality of omni-directional antenna core assemblies which are vertically stacked to produce a low profile omni antenna for a newsstand application, including a desired degree of isolation between the antenna core assemblies.
Figure 2:
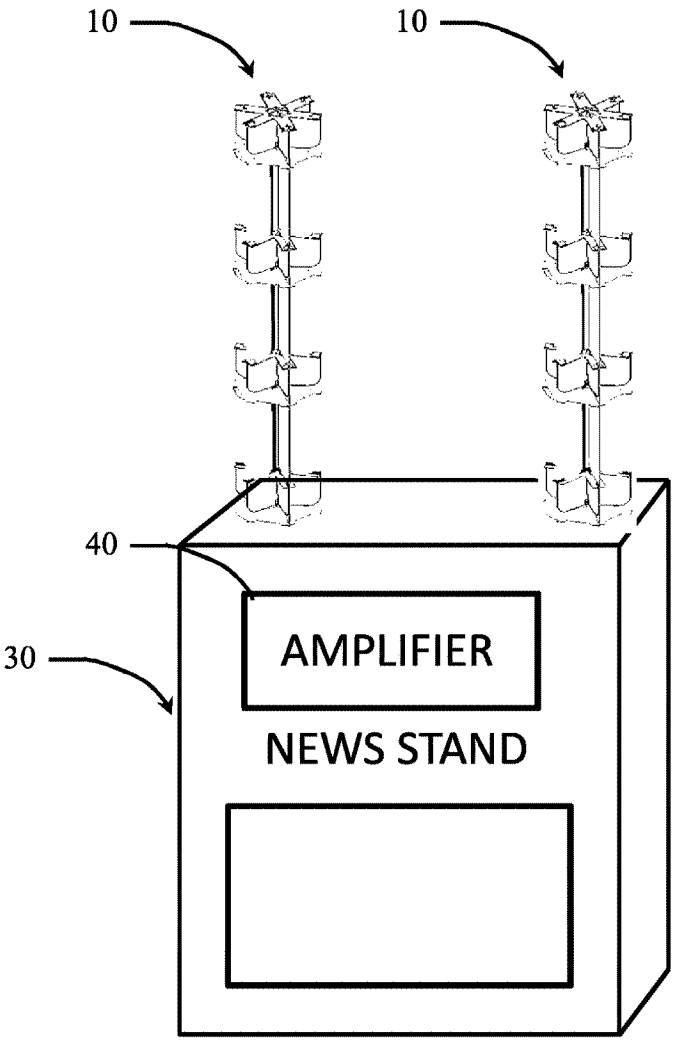
FIG. 2 depicts an embodiment of the disclosure wherein a pair of low profile omni antennas are mounted to, and integrated with, a newspaper stand.

In FIGS. 1-3, a low profile omni antenna 10 comprises a plurality of omni-directional antenna core assemblies 20 which are vertically stacked to produce a low-profile tubular or columnar shape. In the described embodiment, two (2) low profile omni antennas 10 may be mounted atop a newsstand 30, although, any of a variety of structures may be employed. For example, a portable ATM, mailbox, communication device, information display, vending machine or other kiosk may serve as a useful support for mounting one or more low profile omni antennas 10. These structures 30 function as a semi-permanent, semi-portable, multi-purpose mount which can store the requisite electronics 40 (See FIG. 2), e.g., amplifier, while also serving other commercial purposes.

Referring to FIG. 3, in the described embodiment, each low profile omni antenna 10 includes four (4) omni-directional antenna core assemblies 20 which are spaced apart by a dimension S to effect a twenty (20) dBi degree of isolation between the antenna core assemblies 20. To achieve this degree of isolation, the four (4) omni-directional antenna core assemblies 20 may be equally spaced about five inches (5.0") apart measured from one ground-plane 50 to another ground plane 50 or between about 0.90λ to about 0.95λ, where λ is the center wavelength of the radiated antenna frequency band. The isolation decreases as the antenna core assemblies 20 are moved closer together and improves as the antenna core assemblies 20 are spread farther apart.

In the illustrated embodiment, the each of the omni-directional antenna core assemblies 20 radiates a high broadband signal, or frequency, i.e., a frequency greater than about seventeen-hundred megahertz (1700 MHz). While the described embodiment describes antenna core assemblies 20 which radiate high band frequencies, i.e., above seventeen-hundred megahertz (1700 MHz), it will be appreciated that the antenna core assemblies may radiate low and high band frequencies from about six-hundred and ninety-six megahertz (696 MHz) to about twenty-seven hundred megahertz (2700 MHz). The total height H of each low profile omni antenna 10 may be between about sixteen inches (16.0") to about twenty-four inches (24.0").

As illustrated in FIGS. 2 and 3, a low profile omni antenna 10 provides an omni-directional gain pattern that may be deployed at roughly the height of a person. The omni-directional gain pattern is advantageous inasmuch as the RF energy radiated by the low profile omni antenna 10 may be distributed throughout the gain pattern (i.e., in contrast to being concentrated within a narrow antenna gain lobe) while reducing exposure to the RF flux field on a person or objection within a particular coverage area. As such, the omni-directional antenna gain pattern reduces the complexities associated with the RF safety regulations imposed by city/state/national government agencies. Further, given the height of the low profile omni antenna 10, i.e., at the level that a user would normally carry a mobile device, the RF link may be optimized between the mobile device and the antenna. This provides a significant advantage over conventional macro antennas, which must be deployed well above street level, and must be deliberately pointed downward to enable reception of a user's mobile device.

In an alternate embodiment, two or more low profile omni antennas 10 may be deployed coaxially, i.e., one above the other, rather than being juxtaposed side-by-side. In this embodiment, the stacked, or coaxial, configuration can effectively multiply the gain of the combined antennas (one integer multiple per low-profile omni antenna) without significantly altering the omni-directional gain profile.

Figure 4:
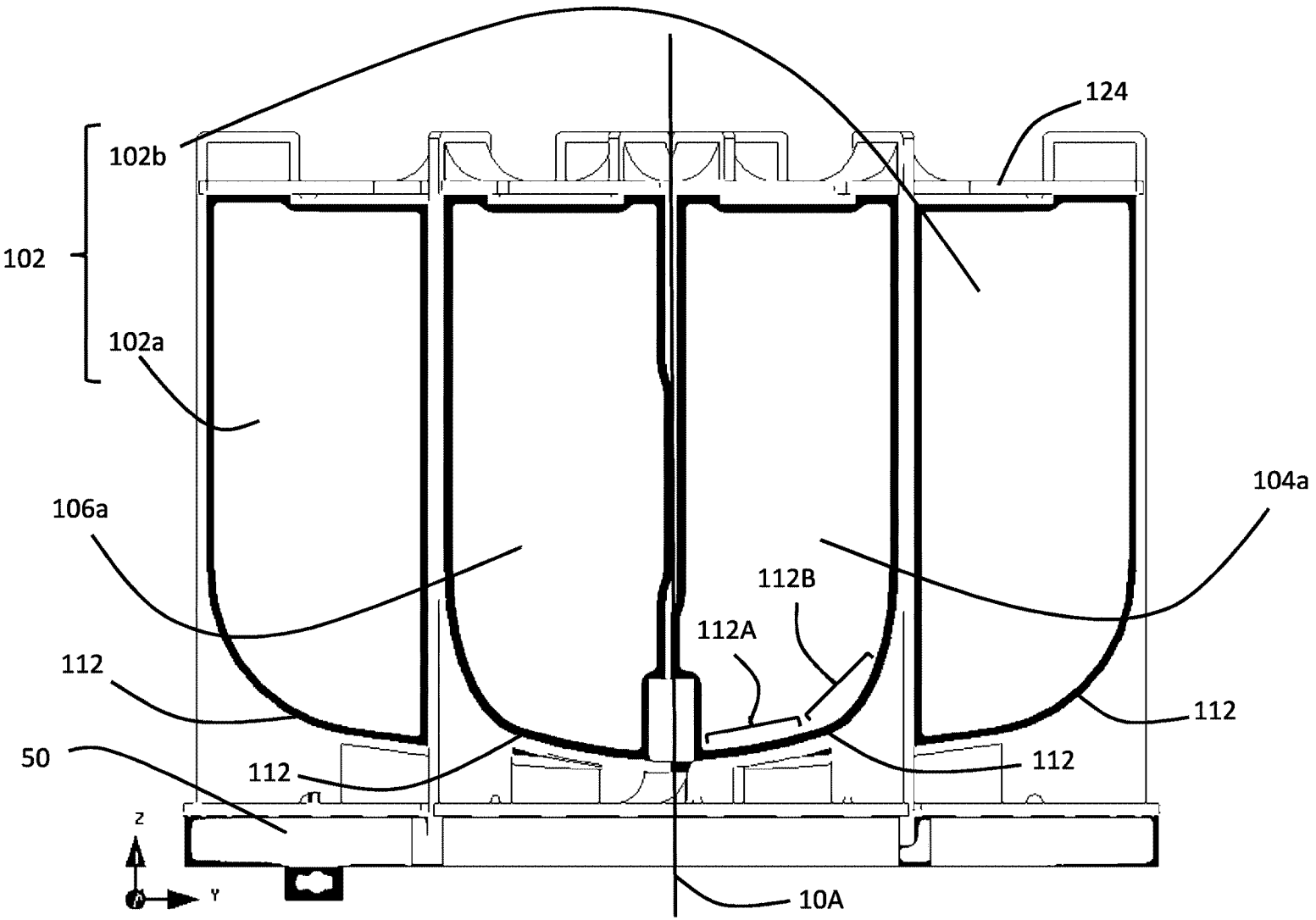
FIG. 4 is a profile view of the omni-directional antenna core assembly illustrating the edge geometry a conductive plate wherein an edge diverges away from the conductive ground plane as the radial distance increases from the central axis.
Figure 5:
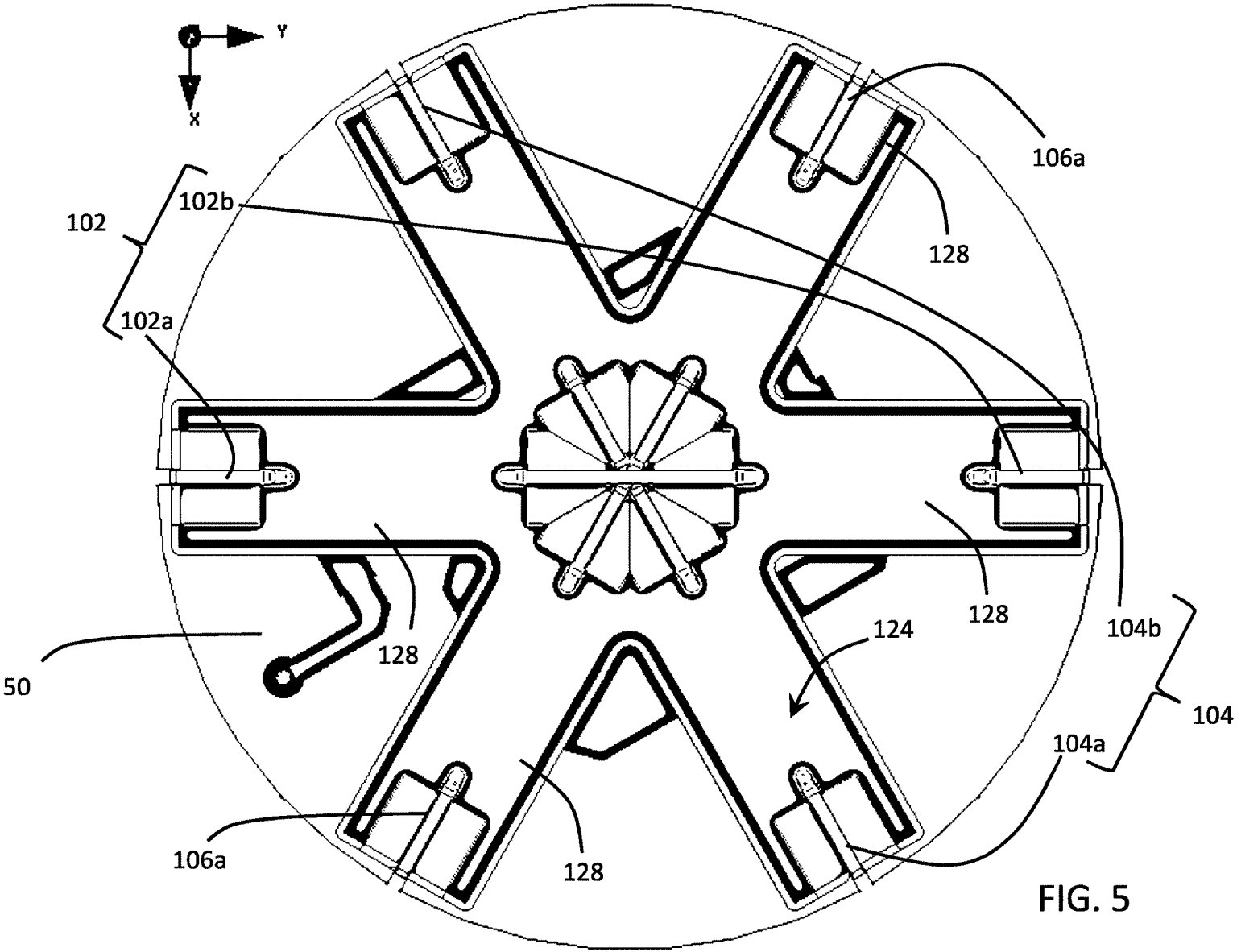
FIG. 5 is a top view of the omni-directional antenna core assembly wherein the plurality of conductive plates comprise three (3) conductive radiator plates each extending across the central axis and disposed in planes which are one-hundred and twenty degrees (120°) apart.

In FIGS. 4 and 5, each omnidirectional antenna core assembly 20 includes a plurality of conductive plates 102*a*, 102*b*, 104*a*, 104*b*, 106*a*, 106*b* projecting orthogonally from the conductive ground plane 50. Furthermore, the conductive plates 102*a*, 102*b*, 104*a*, 104*b*, 106*a*, 106*b* are equiangularly-spaced about an axis 10A normal to the conductive ground plane 50. In the described embodiment, a total of six conductive plates 102*a*, 102*b*, 104*a*, 104*b*, 106*a*, 106*b* project radially outboard from the central axis 10A and define equal angles of sixty degrees (60°) between each of the plates 102*a*, 102*b*, 104*a*, 104*b*, 106*a*, 106*b*.

In FIGS. 4, 6*a*, 6*b*, and 6*c*, each of the plates 102*a*, 102*b*, 104*a*, 104*b*, 106*a*, 106*b* define an edge 112: (i) extending radially outboard from the central axis 10A, and (ii) diverging away from the conductive ground plane 50 as the radial distance increases (in the direction of axis Y) from the central axis 10A. Stated another way, the edge 112 defines a geometric shape corresponding to a "leaf" or "petal." More specifically, the edge 112 defines a first region 112A projecting substantially outboard of the central axis 10A, and a second region 112B outboard of the first region. The second region 112B defines an arc having a radius R between about 0.05λ to about 0.1λ, wherein λ is the center wavelength of the transmitted antenna frequency band. As mentioned above, each of the omni-directional antenna core assemblies 20 radiates a high broadband signal, or frequency, i.e., a frequency greater than about seventeen-hundred megahertz (1700 MHz). Moreover, the first region 112A defines an acute angle β relative to, or with, the conductive ground plane 50, i.e., an acute angle β which is less than about twelve degrees (12°) and a second region 112B outboard of the first region 112A, which second region 112B defines a substantially arcuate shape.

Figure 6A:
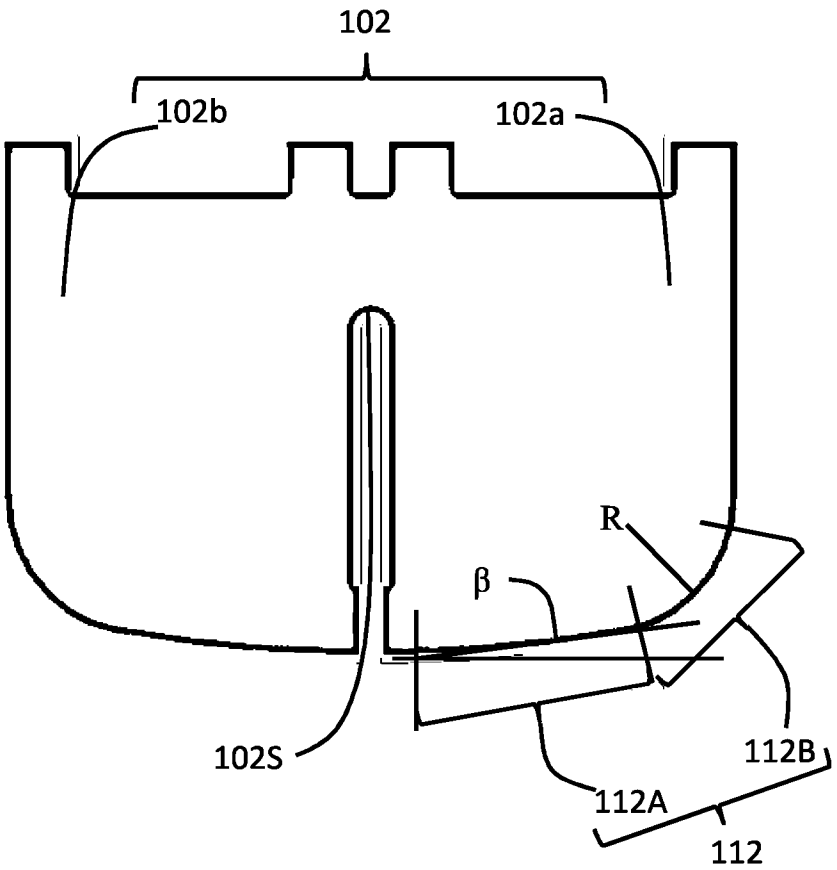
FIGS. 6*a*-6*c* are side views of each of the three conductive radiator plates illustrating the respective slots necessary to interleave the radiator plates for mounting the plates to the conductive ground plane.
Figure 6B:
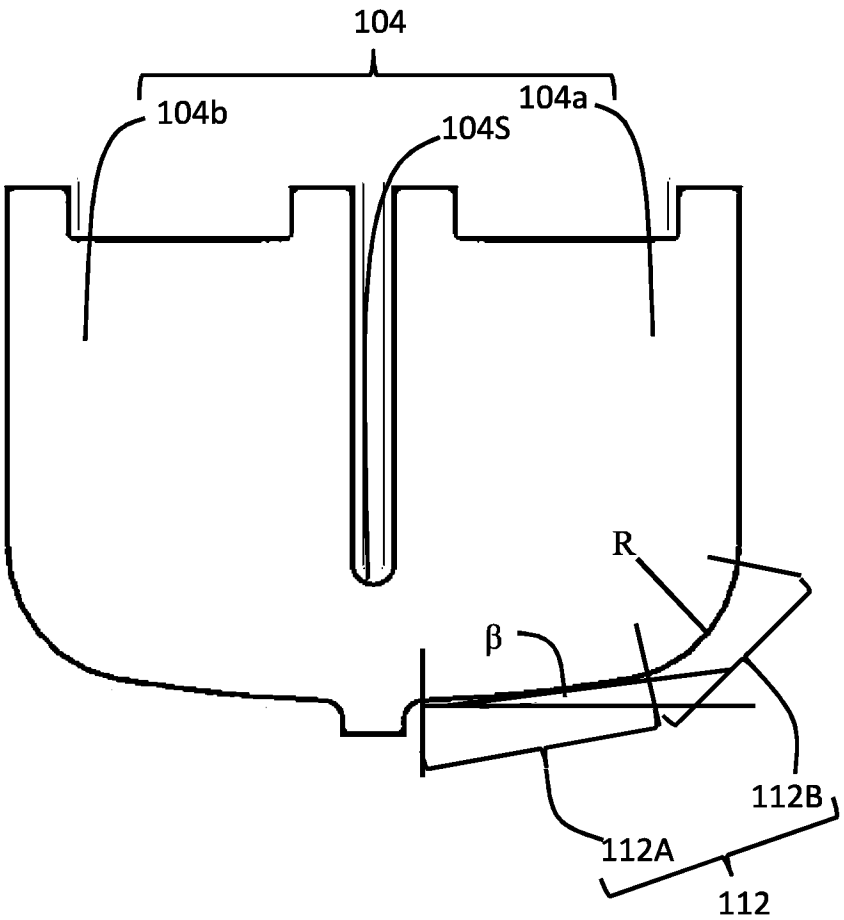
Figure 6C:
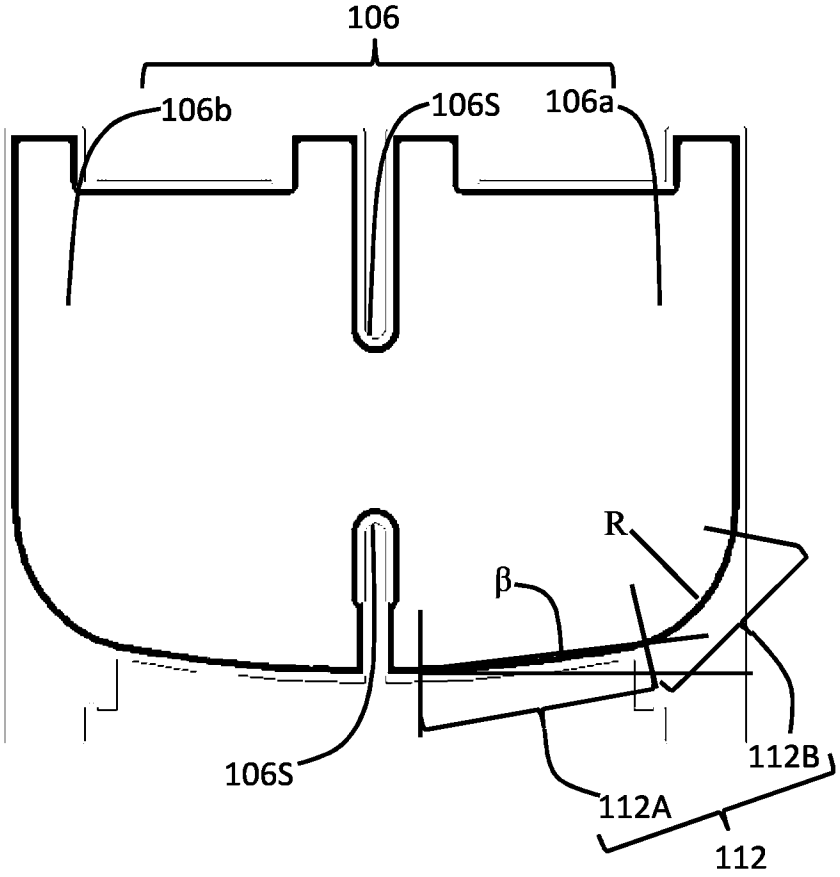

While, in the broadest interpretation, the conductive monopole plates 102*a*, 102*b*, 104*a*, 104*b*, 106*a*, 106*b* may be any planar conductive surface projecting orthogonally of the conductive ground plane 50, in FIGS. 6*a*, 6*b*, and 6*c*, pairs of radially equal conductive plates 102*a*, 102*b*, 104*a*, 104*b*, 106*a*, 106*b* define a plurality of radiator plates extending across the central axis 10A. That is, plates 102*a*, 102*b* may be integrated to form a first radiator plate 102, plates 104*a*, 104*b* may be integrated to form a second radiator plate 104, and plates 106*a*, 106*b* may be integrated to form a third radiator plate 106. The three radiator plates 102, 104, 106 extend across the central axis 10A and in a plane one-hundred and twenty (120°) degrees from the other radiator plates 102, 104, 106. In the described embodiment, the radiator plates 102, 104, may be electrically connected by a planar conductive star structure 124 having a plurality of star arms 128, wherein each star arm 128 corresponds to one of the conductive plate 102*a*, 102*b*, 104*a*, 104*b*, 106*a*, 106*b*. Alternatively, the radiator plates 102, 104, 106 may each include a central slot 102S, 104S and 106S, respectively, and be soldered along the central axis 10A (i.e., where the radiator plates 102, 104, 106 cross) to effect an electrical connection between the plates 102, 104, 106.

The conductive ground plane 50 (see FIG. 5) is substantially circular, although it should be appreciated that the ground plane 50 may take any form including elliptical, polygonal, provided that the ground plane 50 is substantially planar and provides a reflective surface for the radiating elements. In a possible variation, conductive ground plate 50 may have a rectangular shape, whereby the radiator plates may have different dimensions and may be angularly spaced at different angles, depending on the aspect ratio of the rectangle.

In the described embodiment, the conductive ground plane 50 defines a diameter dimension within a range of between about 0.40λ to about 0.48λ wherein λ is the center wavelength of the transmitting frequency band of the antenna. In one embodiment, the diameter dimension of the conductive ground plane 50 is about 0.44λ wherein λ.

Figure 7:
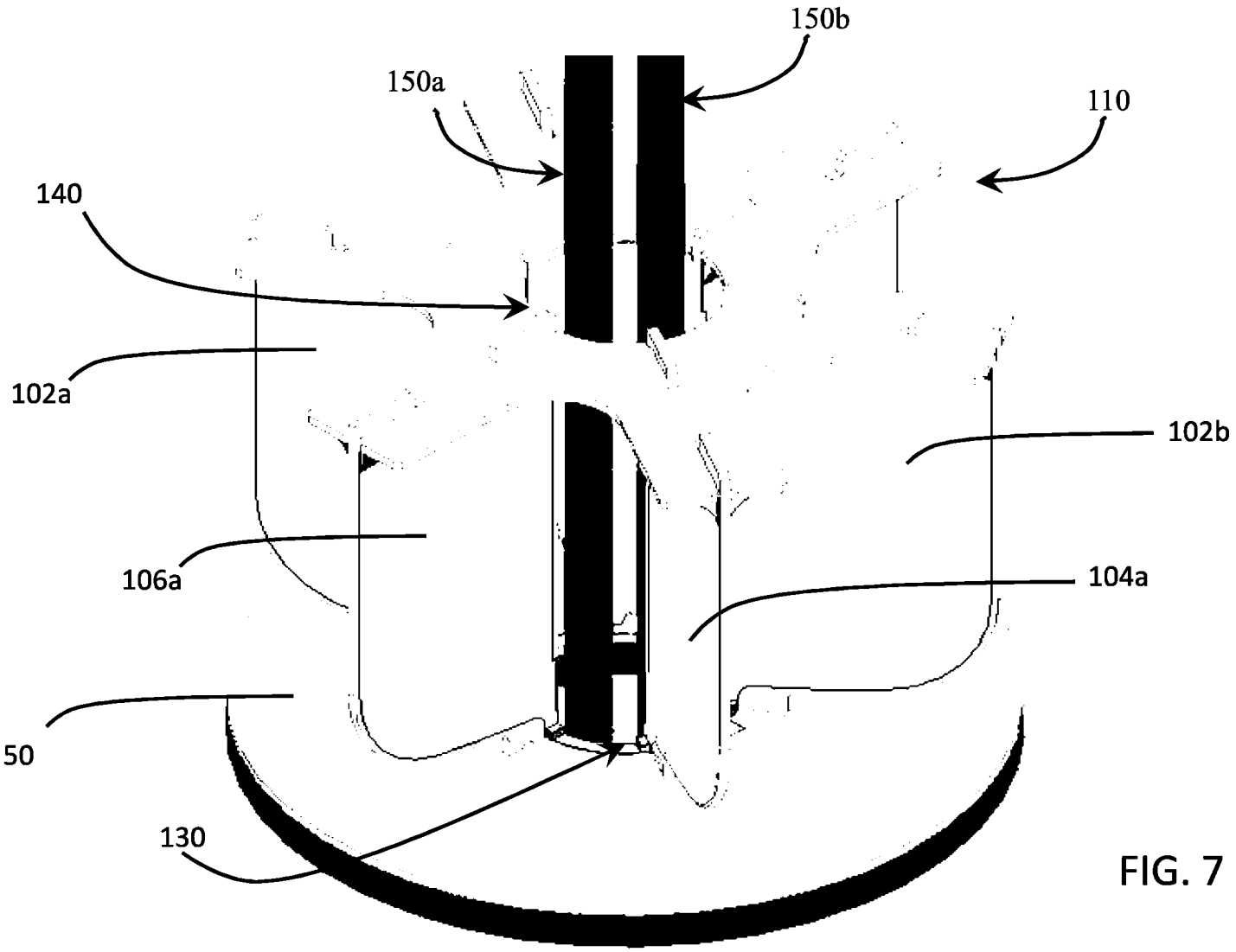
FIG. 7 depicts an alternate embodiment of the stacked omni-core antenna, wherein coaxial cables are routed through the center of each of the antenna core assemblies.

Inasmuch as the low profile omni antenna 10 includes a plurality of vertically stacked omnidirectional antenna core assemblies 20, each must be transmit and receive RF signals via a coax cable or PCB lead. The cable, or PCB lead, supplying the uppermost antenna core assemblies 50 must pass or cross the first, second and penultimate antenna core assemblies 20 and can be a source of interference with respect to these assemblies 20. To minimize the interference, in FIG. 7 the cable 150*a*, 150*b* supplying the upper antenna core assemblies may be fed through aligned apertures 130, 140 disposed in at least one of the conductive ground planes and at least one of the conductive star arms, respectively. As such, the coaxial cables 150*a*, 150*b* may be fed through the apertures on the inside of the antenna core assemblies 50 to minimize interference. In this embodiment, given the aperture that effectively separates each radiator plate 102, 104 and 106 into two separate plates 102*a/b*, 104*a/b*, and 106*a/b*, it is necessary to assure a robust electrical connection between them via their respective connections to planar conductive star structure 124

In summary, the low profile omni antenna of the present disclosure includes one or more omni-directional antenna core assemblies 20, each having a circular ground plane 50 and a set of broad monopole plates 102, 104, 106 each of which define a plane perpendicular to the ground plane and an axis 10A defined by the center of the circular ground plane. Each of the monopole plates 102, 104, 106 has an edge portion which diverges, i.e., is spaced farther away from the conductive ground plane 50 as the radial distance from the central axis 10A increases. The angle and radius of curvature of this portion has a specific shape that provides for a uniform gain profile (very low dBi) in a plane defined by the plane of the broad monopole plate. Each of the antenna core assemblies 20 may operate at a different band, and some operate in a single band, to multiply the gain of the composite antenna at that particular band. Further, the antenna core assemblies 20 may be spaced-apart from each other to optimize band isolation. The monopole plates 102*a*, 102*b*, 104*a*, 104*b*, 106*a*, 106*b* are shaped to increase the bandwidth of the antenna. The shape itself yields an asymmetric horizontal radiation pattern so additional blades are added along different vertical planes to improve omni-directionality. With three blades, offset by 120° degrees each, a very good omni directional pattern approximation is achieved.

The monopole plates 102*a*, 102*b*, 104*a*, 104*b*, 106*a*, 106*b* may be made out of printed circuit board material with metallization on both sides of the boards. When assembled the blades may be electrically connected along the center of the structure, i.e., along the central slots 102S, 104S, 106S, and the metallization along the blades must be electrically connected as well. This is accomplished through solder connections through an interconnection board on top, and between the blades, i.e., through various spots along the center of the blades. The printed circuit boards for each of the monopole plates 102*a*, 102*b*, 104*a*, 104*b*, 106*a*, 106*b* are very similar to each other with variations primarily to avoid physical interference during assembly. One of the blades has a feeding point 160 (see FIGS. 1, 4 and 5) towards the bottom ground plane direction. Each of the monopole plates 102*a*, 102*b*, 104*a*, 104*b*, 106*a*, 106*b* may employ printed circuit board material with metallization on both sides of the respective plate for transmission and reception of RF energy. While dual-sided metallization provides optimum performance, it should be appreciated that the plates may employ printed circuit board material on only one side for reduced soldering requirements and reduced cost. Another embodiment may employ all metal blades, i.e., aluminum blades.

Each of the antenna core assemblies 20 includes a print circuit board feed to excite the radiative assembly, provide an impedance matching network for bandwidth optimization, and a ground plane to function as a reflector for the radiating element. The circuitry faces upwards and includes a transition through the board to a coaxial cable that is routed downwards. The star arm 124 on the top of the radiator plates 102*a*, 102*b*, 104*a*, 104*b*, 106*a*, 106*b* maintains current flow between the radiator plates 102*a*, 102*b*, 104*a*, 104*b*, 106*a*, 106*b* but may not be electrically needed depending on the variation of plate used, or soldering complexity of the antenna core assembly 20. If a soldering technique between the radiator plates 102*a*, 102*b*, 104*a*, 104*b*, 106*a*, 106*b* is used such that the plates are interconnected through the vertical length, the interconnection board may not be required.

Additional embodiments include any one of the embodiments described above, where one or more of its components, functionalities or structures is interchanged with, replaced by or augmented in combination with one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An omni-directional antenna core assembly for use in a stacked, multi-ground plane antenna, comprising:

a conductive ground plane defining an axis normal to the conductive ground plane;

a plurality of conductive plates projecting orthogonally from the conductive ground plane and angularly spaced about a central axis;

each conductive plate having an edge extending radially outboard from the central axis, the edge defining a first region and a second region radially outboard of the first region, the first region diverging linearly away from the conductive ground plane as a radial distance increases from the central axis and the second region defining an arcuate shape which diverges exponentially away from the conductive ground plane and defining a radius of curvature between about 0.05λ to about 0.1λ, wherein λ is a wavelength of a transmitted antenna frequency.

2. The omni-directional antenna core assembly of claim 1 wherein pairs of radially equal conductive plates define a plurality of radiator plates extending across the central axis.

3. The omni-directional antenna core assembly of claim 2 wherein the plurality of conductive plates comprise three radiator plates, each extending across the central axis and in a plane one-hundred and twenty (120°) degrees from the other radiator plates.

4. The omni-directional antenna core assembly of claim 2 wherein each of the radiator plates includes a slot for interleaving at least two radiator plates across the central axis.

5. The omni-directional antenna core assembly of claim 1 wherein the conductive plates are electrically connected by a planar star having a plurality of star arms, each star arm corresponding to each conductive plate.

6. The omni-directional antenna core assembly of claim 1 wherein the edge of a first region defines an acute angle with the conductive ground plane which is less than about twelve degrees (12°) and a second region outboard of the first region, the second region defining a substantially arcuate shape.

7. The omni-directional antenna core assembly of claim 1 wherein conductive ground plane is substantially circular and defines a diameter dimension within a range of between about 0.40λ to about 0.48λ wherein λ is a wavelength of a transmitting frequency of the antenna.

8. The omni-directional antenna core assembly of claim 1 wherein conductive ground plane is substantially circular and defines a diameter dimension of about 0.44λ wherein λ is a wavelength of a transmitting frequency of the antenna.

9. The omni-directional antenna core assembly of claim 8 wherein each conductive radiator plate defines a width dimension of about 0.42λ wherein λ is the wavelength of the transmitting frequency of the antenna.

10. An omni-directional antenna comprising:

a plurality of stacked omni-directional antenna core assemblies, each omni-directional antenna core assembly, comprising:

a conductive ground plane defining an axis normal to the conductive ground plane;

a plurality of conductive plates projecting orthogonally from the conductive ground plane and equiangularly spaced about a central axis;

each conductive plate having an edge extending radially outboard from the central axis and diverging away from the conductive ground plane as a radial distance increases from the central axis.

11. The omni-directional antenna of claim 10 wherein each of the stacked omni-directional antenna core assemblies is spaced apart by a vertical dimension of between about 0.9λ to about 0.95λ wherein λ is a center wavelength of a transmitting frequency band of the antenna.

12. The omni-directional antenna of claim 11 wherein each of the stacked omni-directional antenna core assemblies is about 0.93λ.

13. The omni-directional antenna of claim 10 comprising at least four stacked omni-directional antenna core assemblies.

14. The omni-directional antenna of claim 13 wherein each stacked omni-direction antenna core assembly radiates a different frequency band.

15. The omni-directional antenna of claim 13 wherein each stacked omni-direction antenna core assembly radiates at a same frequency band greater than about seventeen-hundred megahertz (1700 MHz).

16. The omni-directional antenna of claim 10 wherein at least one of the conductive ground planes defines a first aperture, wherein the conductive plates are electrically connected by a planar star having a plurality of star arms, each star arm corresponding to each conductive ground plane and at least one of the star arms defining a second aperture aligned with the first aperture, the omni-directional antenna further comprising a coaxial cable connecting to each stacked omni-directional antenna core assembly and received by the at least one first and second apertures of the conductive ground plane and star arm, respectively.

* * * * *